US005209691A

United States Patent [19]

Ekstein

[11] Patent Number: 5,209,691

[45] Date of Patent: May 11, 1993

[54] CHILDREN'S TOY AND GARMENT

[76] Inventor: Penny Ekstein, 577 Second Ave., New York, N.Y. 10016

[21] Appl. No.: 882,881

[22] Filed: May 14, 1992

[51] Int. Cl.[5] ..... A63H 33/00; A63B 69/00

[52] U.S. Cl. ..... 446/28; 2/2; 2/48; 2/80; 482/88

[58] Field of Search ..... 446/28, 26, 27; 482/83, 482/88; 2/18, 48, 2, 80, 69

[56] References Cited

U.S. PATENT DOCUMENTS

| | | | |
|---|---|---|---|
| 1,424,013 | 7/1922 | Hale | 2/48 |
| 1,816,566 | 7/1931 | Burstein et al. | 2/48 |
| 2,675,554 | 4/1954 | Gertz | 2/80 |
| 2,705,803 | 4/1955 | Sheldrick et al. | 2/80 |
| 4,580,296 | 4/1986 | Cano | 2/18 X |

*Primary Examiner*—Mickey Yu

[57] ABSTRACT

A combination children's garment and children's toy includes both a padded portion providing protection from the impact ordinarily encountered during a boxing match, and a decoy face on the front of the garment intended to attract the punches thrown by the opponent. Both of these features provide safety during use of the toy. The toy includes a set of boxing gloves attached by sleeves, potentially permanently, to the garment. The sleeves are adjustable in length to fit the user. The face on the front of the garment provides additional entertainment during use of the garment, thus encouraging full enjoyment of both safety features of the invention. This is accomplished by providing the padding in the front of the garment, at the very location where the face is provided on the garment. The face is provided in the torso area, thus reducing the tendency to strike the opponent in the head, but rather encouraging blows directed to the heavily padded decoy face provided on the torso. Sound producing device may also be provided in the padded portion for producing sound when the padded portion is struck by the opponent.

18 Claims, 3 Drawing Sheets

CHILDREN'S TOY AND GARMENT

FIELD OF THE INVENTION

The present invention relates to a combination children's garment and children's toy. In particular, the invention relates to the provision of a protective garment including both a padded portion providing protection from the impact ordinarily encountered during a boxing match, and a decoy face provided on the front of the garment intended to attract the punches thrown by the opponent. Both of these features provide safety during use of the toy. The garment has a set of boxing gloves attached, potentially permanently, to the garment. Of course, the face provided on the front of the garment provides additional entertainment during use of the garment, thus encouraging full enjoyment of both safety features of the invention. This is accomplished by providing the padding in the front of the garment, at the very location where the face is provided on the garment. The face is provided in the torso area, thus reducing the tendency to strike the opponent in the head, but rather encouraging blows directed to the heavily padded decoy face provided on the torso. Furthermore, the garment can be readily enjoyed by a single child who is not involved in a boxing match. The boxer's face and boxer trunks that appear on the front of the garment will provide enormous assistance in the creation of the image of being a boxer, thus enabling a child to fantasize about being a professional boxer. Still further, the parents of the child can enjoy the child's entertaining behavior while the child is dressed in the garment and enjoying an imaginary boxing match.

BACKGROUND AND SUMMARY OF THE INVENTION

Boxing is a sport that is particularly attractive to young children during the early years when they must learn to vent their aggressive behavior in socially acceptable ways. For parents, there is generally a concern for the safely of their children whenever they participate in activities involving any manner of fighting. The present invention addresses the parents' concern by providing protective clothing and by directing the child's aggression towards a heavily padded decoy face rather than towards an opponent's head. This is done by providing a well padded front portion of the garment and providing a "target" on this padded portion of the garment. The target is the face of, for instance, a professional boxer. In the interest of creating the most interesting face for young children, the face could be very fanciful. Thus, the face that is provided could be that of a ferocious fighter, with all the cartoon-like scars and other features that would most readily stimulate the imagination of the young fighter.

A problem sometimes encountered in boxing among young children is loss of the gloves, resulting in bare hands boxing. This is generally limited to very young children who may not fully understand the risks attendant to bare hands fighting. In older children, where the danger of boxing is better understood, both fighters will generally stop promptly if a glove is lost. This is not necessarily the case with younger children. This risk is amplified by the very small hands of such young children, thus making it difficult to design gloves that can be secured without risk of being lost during a fight. Among the approaches employed previously for designing gloves for young fighters is reducing the weight (and thus the thickness) of the gloves. While this is helpful in keeping the gloves on the fighters' hands, it has the disadvantage of reducing the padding provided for protection. Another approach attempted for keeping the gloves on the hands of boxers involves the extensive use of laces This approach is complicated by the need for un-gloved hands for securing the gloves to each hand. Thus, there must be free hands for the full gloving of the fighters. While this may be feasible in professional boxing, it is definitely not feasible for young boxers. As a result, young boxers frequently skip the laces and end up with the very problem that was intended to be avoided by the complex lacing arrangement. Thus, this approach has not been a viable solution for very young children.

According to the present invention, the young boxer wears a boxing uniform that is decorated with the face of a professional boxer, real or imaginary. The face is provided on the front of the torso of the uniform, providing a target for the opponent. The uniform is particularly well suited to decoy the punches away from the child's head and towards the torso. Consistent with the safety features of the invention, the torso section of the uniform is padded to provide protection from blows thrown by the opponent. The appearance of the boxer's face on the front of the uniform is complemented by the provision of the image of boxer's trunks immediately below the boxer's face. This creates a fanciful image of a cartoon-like boxer and is particularly well suited to stimulate the child's imagination and thus to enhance the enjoyment of the wearing of the uniform.

The garment may be worn as a piece of clothing or it may be a pillow-like front portion that is secured to the front of the child by, for instance, elastic straps that are provided to loop behind the child's neck and legs. The image on the front of the garment may include three dimensional features to further enhance the enjoyment of the garment. For instance, the nose of the illustrated boxer may extent forward to provide a good target for the child. In addition to providing a good target, this feature will increase the child's ability to imagine that he is the boxer himself as he wears the garment with the boxer's image on the front.

It is an object of the present invention to provide a child's toy that permits a child to engage in fanciful boxing without being subjected to the dangers typically encountered in boxing.

It is another object of the invention to provide a padded and decorated boxing toy having a simulated face of a boxer on the front of the toy to promote imaginary competition in the sport of boxing while protecting the child wearing the padded toy from being exposed to the typical dangers of boxing.

It is still another object of the invention to provide a padded garment to be worn on the front of a child's torso during a boxing contest to enhance the child's feeling of enjoyment while at the same time protecting the child.

It is yet another object of the invention to provide a garment for simulated boxing having adjustable sleeves, each of the adjustable sleeves, having boxing gloves attached to the ends so the length of the sleeves may be conformed to the length of the arms of the child wearing the garment.

It is also an object of the invention to provide a garment to be worn by a child in a manner such that the opponent in a boxing match will direct the punches towards the padded torso rather than the child's head. This is done by providing a fanciful boxer's face on a portion of the padded torso portion of the garment and by providing the image of boxer's trunks along the lower portion of the garment.

It is another object of the invention to provide a garment having combinations of the features described in these objects.

DESCRIPTION OF THE PREFERRED EMBODIMENT OF THE INVENTION

Figure 1:
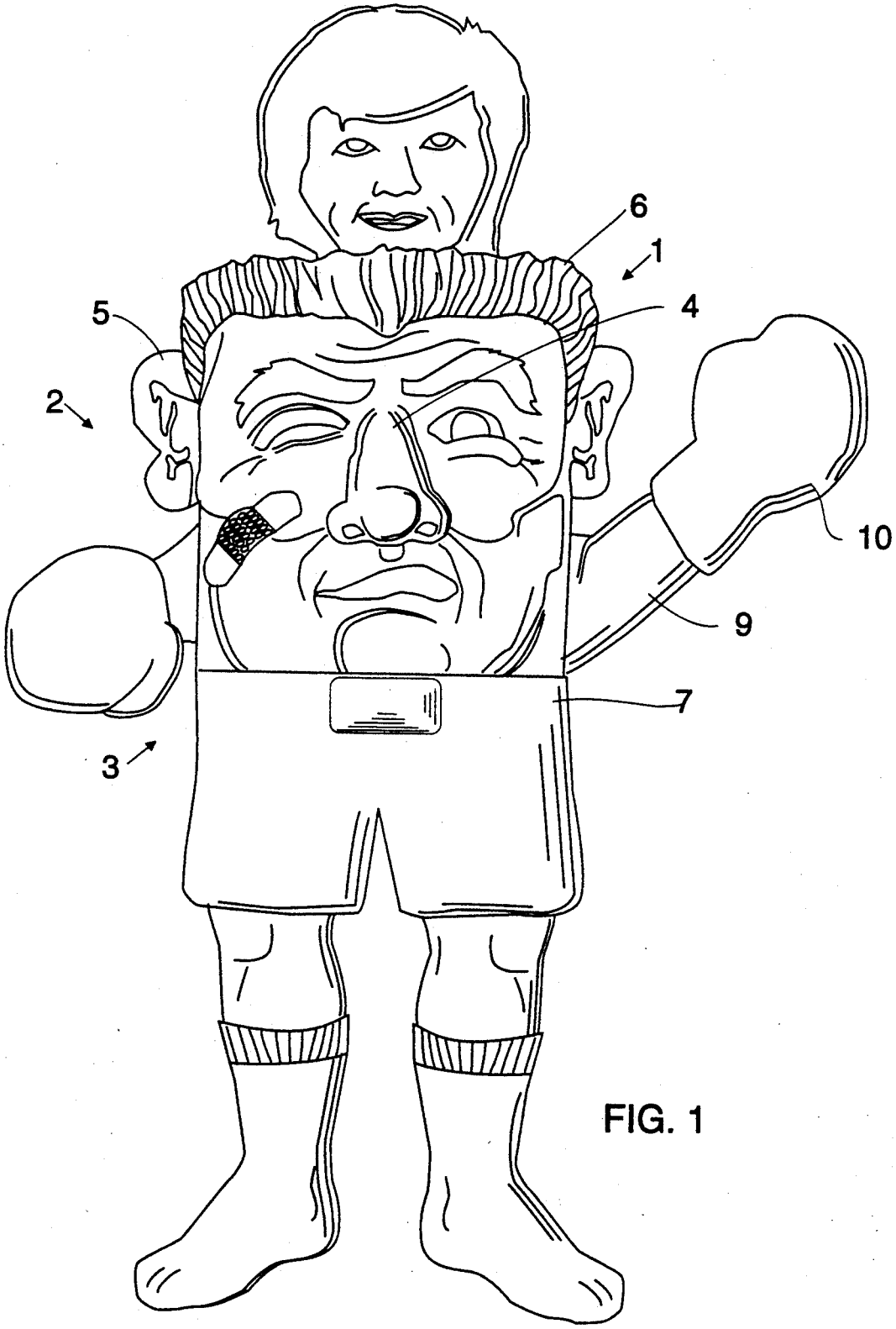
FIG. 1 shows a child wearing a first embodiment of the invention with a boxer's face and boxing trunks.

Referring to the figures, FIG. 1 illustrates a child wearing a preferred embodiment of the invention. The padded front portion 1 of the garment is provided with an image of a boxer's face 2 and a boxer's trunks 3. The boxer's nose 4 is three dimensional and extends out from the surface of the padded front portion of the garment, as more fully shown in FIG. 4. Ears 5 are provided on the sides of the boxer's head 2 and a fringe 6 along the top of the garment simulates the boxer's hair. A simulated waistband 7 contains a fanciful "manufacturer's name" and the trunks resemble real boxers' trunks. However, in this arrangement, the garment is not a complete garment, but is rather designed to be worn over the child's regular clothing. Thus, the padded front portion is secured to the child by a set of straps 8A, 8B that circle behind the child, preferably elastic straps behind the child's neck 8A and legs 8B, as more fully shown in FIG. 3. The child's arms are inserted into the garments arms 9, which arms are provided with simulated boxing gloves 10. The child's hands are inserted into the gloves 10, which are heavily padded, as is suitable for simulated boxing. The combination of a padded torso portion 1 of the garment and the padded gloves 10 provides a reasonable degree of safety for a young boxer. The images of the boxer's face 2 and trunks 3, on the front of the garment tend to attract the blows thrown so that punches are directed towards the torso rather than towards the child's face.

To further encourage the striking of the torso rather than the child's face, a supplemental attraction is provided in the preferred embodiment of the invention. A child is usually entertained by an audio stimuli and the present invention relies on this additional feature by providing a sound maker 41 (shown in FIG. 4) in the nose 4 of the boxer. Thus, when the nose 4 on the front of the torso portion i of the garment is firmly struck, a funny sound is produced. In a slight modification of this feature, the sound may be made somewhat more realistic with respect to what a prizefighter may utter when struck in the nose. Thus the sound may be either funny or crass or otherwise entertaining for the child.

Figure 2:
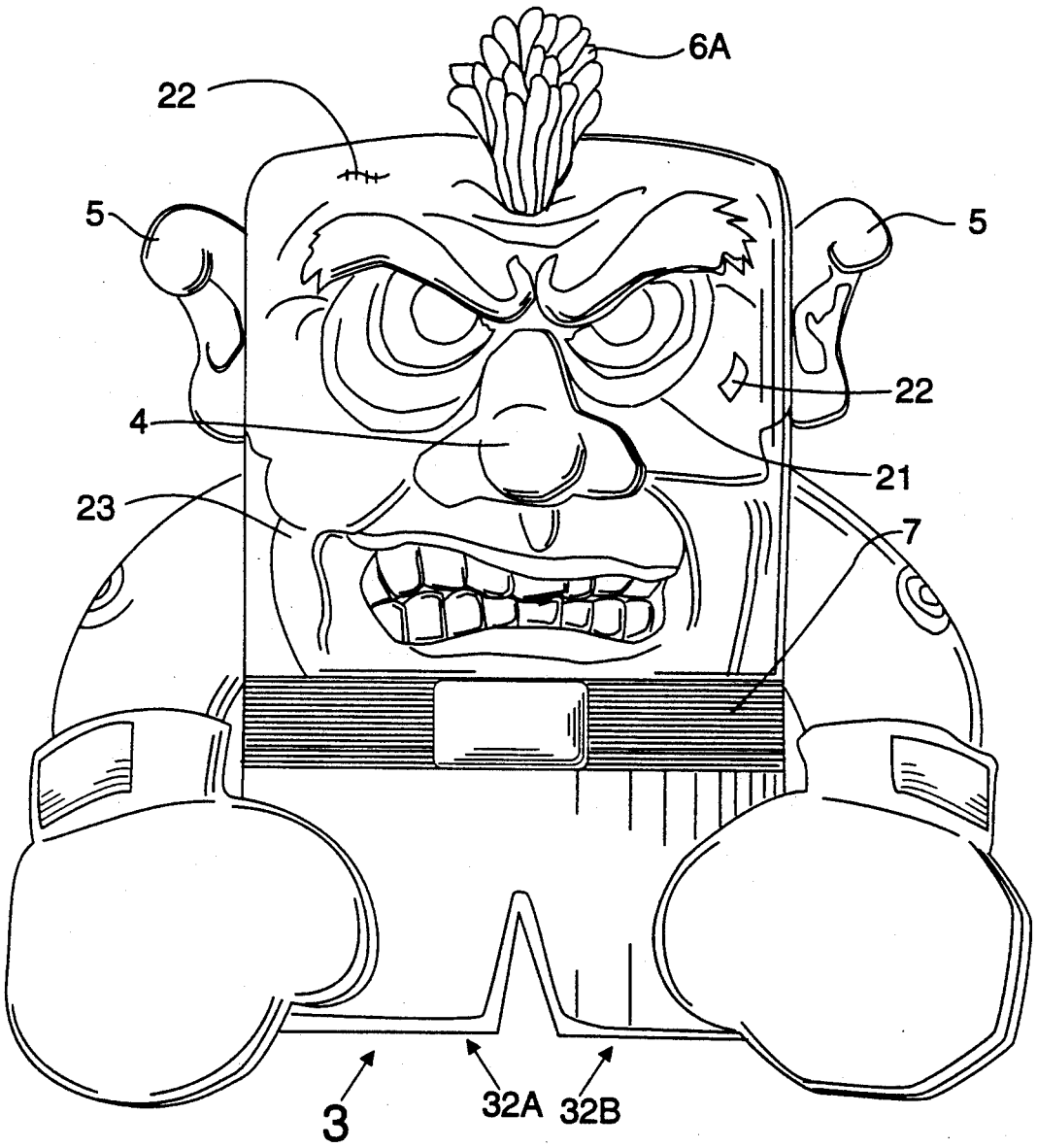
FIG. 2 shows the front of another embodiment of the invention.

Referring next to FIG. 2, the details of the front padded portion of the children's toy can be demonstrated. The front portion of the garment that makes up this children's toy is preferably quilted to accentuate the features on the face 2 of the boxer. Thus, stitching is provided around the periphery of one or more of the facial features of the boxer, illustrated here as stiching 21 around the boxer's eye. This, combined with the thick padded torso portion of the toy, provides a three dimensional effect. To further accentuate the features of the boxer's face, the nose 4 is provided in accentuated relief, as more fully shown in FIG. 4. Also, ears 5 are provided on each side of the boxer's head to further enhance the visual stimulation of the child playing with this toy. Further visual stimulation is provided by including a tuft of hair 6A on the boxer's head. In this embodiment, the hair comprises a cluster of threads of yarn. This is to be distinguished from the gathered cloth fringe 6 that is illustrated with respect to the hair of the fighter shown in FIG. 1. The boxer's trunks are actually a continuation of the single padded torso member that makes up the face of the boxer. However, to give this portion of the toy a separate appearance, a waistband portion 7 is formed by either forming a gathered fabric portion of the layer of fabric making up the front of the padded portion, or by attaching a gathered waistband to the front surface of the padded member. For still greater visual stimulation, the front of the garment is brightly colored with bright hair 6A, a bulbous red nose 4, various cuts and bruises 22 and a heavy bearded complexion 23.

The trunks 3 of the boxer are simply a continuation of the fabric layer that makes up the boxer's face. While it would be feasible to provide a separate fabric portion for the trunks, for instance if there is a desire to provide a shiny fabric to simulate silk, or perhaps to actually provide silk trunks, this fabric transition could conveniently be implemented along the waistband 7 that has been described above. In the embodiment shown, the lower portion of the padded front portion of the garment includes leg extensions 32A, 32B to further enhance the appearance of the boxer while simultaneously allowing the child to have increased flexibility for his legs. Even so, the padded portion of the garment provides protection for the child's lower body portions which are behind the simulated trunks. Thus, the toy provides both a visually stimulating appearance and a protective feature. Even further, the toy provides sufficient rigidity to cause the front of the garment to retain its original shape and appearance even as the wearer moves his body through the motions of a prizefighter.

Figure 3:
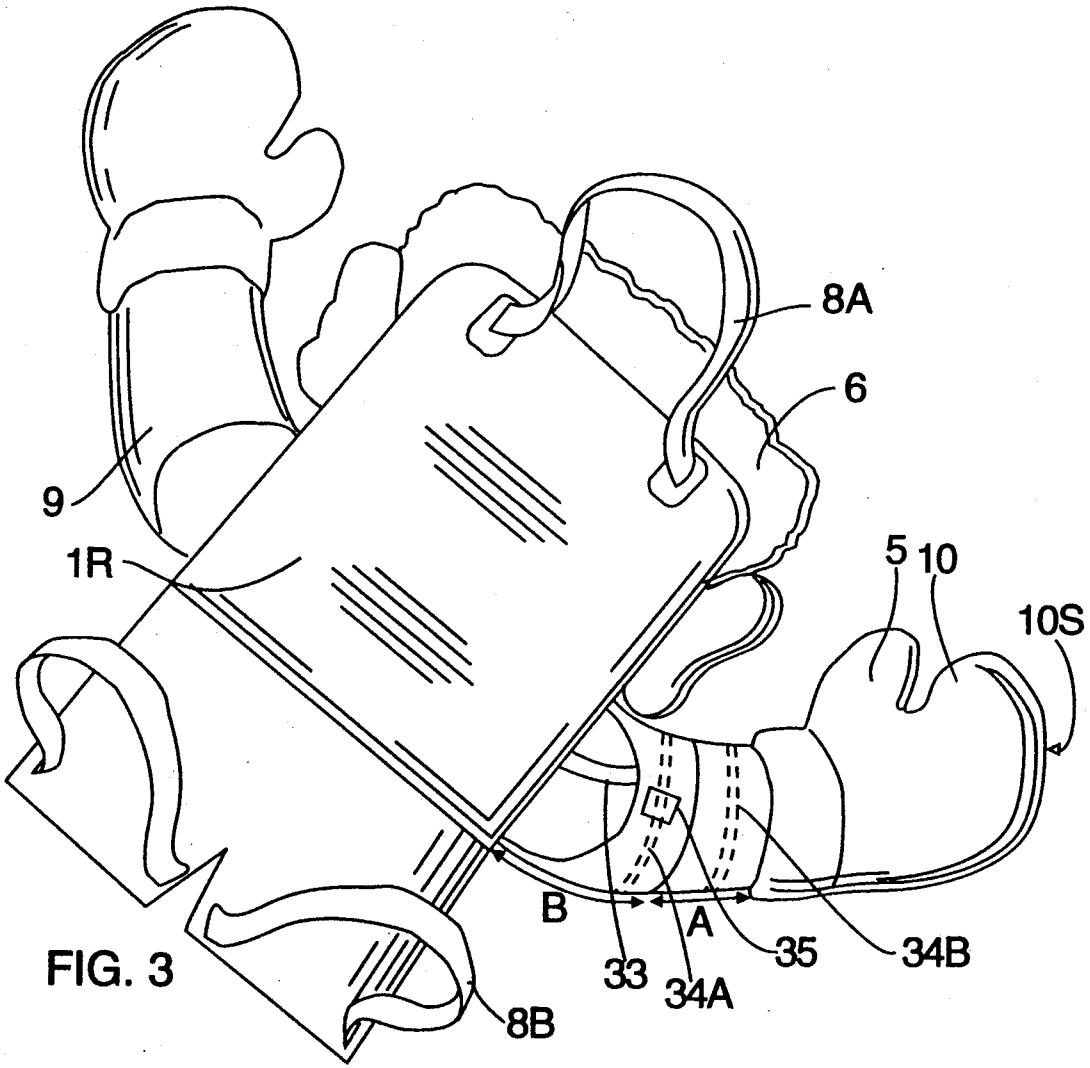
FIG. 3 shows a rear view of an embodiment of the invention where elastic straps are employed to secure the garment to the wearer.

Referring next to FIG. 3, the rear surface 1R of the toy can be seen. In this figure, the elastic straps 8A, 8B of the preferred embodiment are shown. These straps will loop around the child's neck 8A and legs 8B to hold the padded front portion of the toy against the child's torso. The child's arms are inserted into the arms 9 of the toy and the hands go inside of the gloves 10 where there may be additional padding, generally filling the striking portion 10S of the glove. Also shown is an elastic strap 33 that may be provided in each arm to aid in keeping the child's hands securely located in the glove portion of the toy. By securing the elastic strap to the inside of the glove, and securing the other end to the torso portion of the toy, the gloves will be pulled towards the wearer. This will cause the hands to be pressed into the gloves. The elastic straps are adjustable to accommodate children's arms as they grow. In the preferred arrangement, the arms of the toy are attached to the torso portion of the toy by elastic straps that provide the force necessary to keep the child's hands pressed into the gloves. In this arrangement, the first arm portion (designated by length "A") of the toy can be designed to extend from the child's hand up to the child's elbow. This will provide maximum freedom of movement for the child yet will provide a good, reliable method for keeping the gloves on the hands of the child, even through the vigorous activities of boxing. Also illustrated is a second arm portion (designated by length "B") extending from the wearer's elbow towards the wearer's shoulder. In an alternate implementation of the garment, the second length is elastic and the first length is of a sturdy fabric, with less stretch than the elastic portion. A feature of this arrangement is the length adjustment 34B provided in length A of the sleeve. The fabric may be gathered along dashed line 34B and a conventional clasp may be employed to clamp the gathered fabric and thus to effectively shorten the length of the first portion of the sleeve. A similar fabric shortening technique may be employed along line 34A, and the securing member 35 will provide the locking force needed to retain the shortened length of the sleeve.

While the length adjustment mechanism described above will work reasonably well, it may be preferable in some situations to employ alternatives such as drawstrings sewn into the length of either or both of the first and second sleeve portions. Also, the fastener 35 may be a hooks and loops fastener sold under the trademark VELCRO or any other self adhering arrangement.

Figure 4:
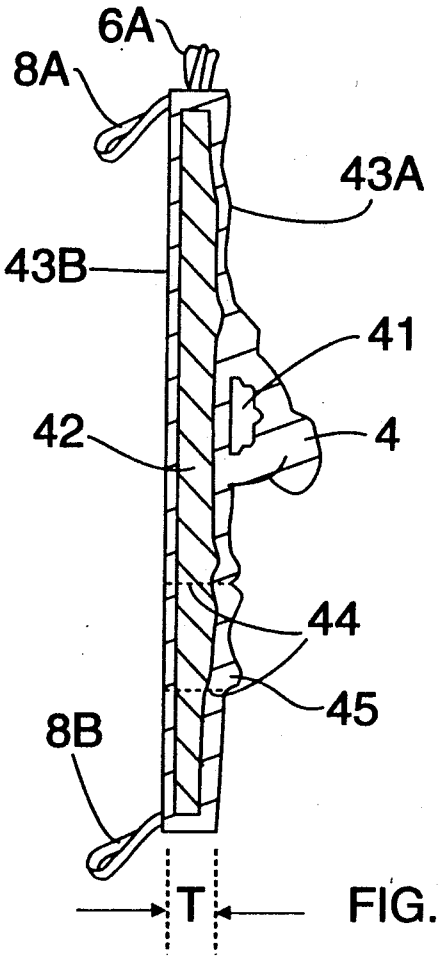
FIG. 4 shows a cross section of an embodiment of the invention wherein the boxer's nose extends out from the front surface of the garment.

Referring next to FIG. 4, the three dimensional features of the front portion of the toy can be seen. The thickness T of the front padded portion is determined by the thickness of the padding 42 provided plus the thickness of the front 43A and rear 43B layers of fabric. It is anticipated that the thickness of the front will be determined in part by the overall size of the torso section. For larger children, a thicker pad may be desired in consideration of the expected greater punching power of a larger child. For younger children, the thickness may be on the order of an inch. This thickness will provide a reasonable compromise between the need for structural integrity and the desire for a weight that is suitable for the child wearing the toy. The fabric is suitably selected from cotton cotton blends and artificial fabrics such as rayon, polyester and blends with natural fibers. As mentioned earlier, silk would be feasible for the boxer's shorts. In the currently envisioned embodiment, a poly-cotton blend will provide a good mix of strength and durability.

The stitching 44 that defines the features on the boxer's face can be seen to create depressions in the surface of the padded portion of the toy. The nose 4 is a separate element that is secured to the front of the padded portion and is shown to contain a noise making element 41, here, a whistle connected to an air bladder. Thus, when the nose is compressed, the whistle will blow. It is also possible to employ an electrically operated sound maker that is actuated by compression of a switch or button. This alternative may be selected if it is desired to have the boxer utter some comment when his nose is firmly punched. While the sound maker is described and shown as being located in the boxer's nose, it may just as easily be located in the chin 45 or any other portion of the toy. Similarly, more than one sound making device could be employed.

While the foregoing description of the preferred embodiment of the invention illustrates the various features of the invention, it is to be understood that this description is for purposes of illustration and not for purposes of limitation of the protection afforded by this patent. The invention is intended to be protected to the full extent available as more extensively defined in the following claims.

What is claimed is:

1. A child's toy comprising:

a padded front body panel for covering the front of a child, two sleeves having padded boxing mitts for said child's hands, elastic material drawing said sleeves toward said padded front body panel, said padded front body panel comprising first and second fabric layers enclosing a shock absorbing padding material having a thickness of greater than about one inch and having, on one of said layers of fabric, a rendering of a boxer, said rendering comprising a brightly colored and quilted demarcation of the facial features of said boxer, including a protruding nose containing a sound making device.

2. A child's toy as claimed in claim 1, wherein:

said padded front panel comprises a quilting design corresponding to a face of a boxer within said rendering of a boxer to provide dimensional relief to the surface of said padded front panel, thus providing enhanced visual reality to the rendering of said face of a boxer.

3. A child's toy as claimed in claim 2, wherein:

said elastic material drawing said sleeves toward said padded front body panel comprises a portion of the length of each sleeve along a first span of said sleeve between said child's elbow and said child's shoulder.

4. A child's toy as claimed in claim 1, wherein:

a first portion of said sleeves extends from said child's hands to said child's elbows, and said elastic material drawing said sleeves toward said padded front body panel connects said first portion of said sleeves to said padded front body panel.

5. A child's toy as claimed in claim 4, wherein:

a second portion of said sleeves extends from said child's elbow to said child's shoulder, said second portion comprising an elastic sleeve portion.

6. A child's toy as claimed in claim 5, wherein:

a fabric gatherer is provided in said first portion of said sleeves to provide adjustment of the length of said first portion of said sleeves to fit the child wearing said toy.

7. A child's toy as claimed in claim 5, wherein:

a fabric gatherer is provided in said second portion of said sleeves to provide adjustment of the length of said second portion of said sleeves to fit the child wearing said toy.

8. A child's toy as claimed in claim 5, wherein:

a first fabric gatherer clamp is provided in said first portion of said sleeves to provide adjustment of the length of said first portion of said sleeves to fit the child wearing said toy, and a second fabric gatherer clamp is provided in said second portion of said sleeves to provide adjustment of the length of said second portion of said sleeves to fit the child wearing said toy.

9. A child's toy as claimed in claim 1, wherein:

said gloves include a poly-cotton padding material substantially surrounding the child's hand, said gloves include a soft and smooth poly-cotton fabric covering, said gloves include a cuff portion, said cuff portion including an ornamental design simulating laces and a manufacturer's label, said design simulating laces being free from rough surface features which might cause abrasions.

10. A child's toy as claimed in claim 1, wherein:

said padded front panel includes a first elastic neck strap attached to the rear of the panel generally along the top edge of the panel, said padded front panel includes elastic leg straps attached to the rear of the panel generally along the bottom edge of the panel.

11. A garment for a child comprising:

a boxing simulation toy, including, a padded front body portion covering the front of the child's torso, sleeves having padded mittens for the child's hands, a retainer to draw said mittens towards said body portion while said garment is being worn by said child, said garment having decorations on a front surface including a boxer's face and a boxer's trunks, said trunks including a decorative waistband.

12. A garment for a child as claimed in claim 11, wherein:

said retainer comprises a drawstring along the decorative waistband of said boxer's trunks.

13. A garment for a child as claimed in claim 11, wherein: said retainer comprises an elastic member in said sleeve.

14. A garment for a child as claimed in claim 11, wherein:

said sleeves have an adjustable length.

15. A garment for a child as claimed in claim 14, wherein:

the length of said sleeves is adjustable by a given length adjuster selected from the group of length adjusters consisting of:

drawstrings sewn into the sleeves, fabric clips attached to the sleeves, elastic bands attached to the sleeves for securing fabric tucked under the elastic bands, and hooks and loops fastener strips attached to the sleeves.

16. A toy for children, free from sharp corners and small pieces, comprising:

a padded pillow body portion having a generally rectangular shape and having first and second leg extensions along a bottom edge of said generally rectangular body portion;

a leg strap affixed to each of said first and second leg extensions;

said body portion having a neck strap affixed along a top edge of said generally rectangular body portion;

said neck strap including an elastic portion;

left and right sleeves provided on respective left and right edges of said body portion and a padded boxing glove provided at the end of each said sleeve.

17. A toy for children as claimed in claim 16, wherein:

said padded boxing gloves include quilting, a boxer's face and boxing trunks are shown on the front surface of said body portion and said leg extensions.

18. A toy for children as claimed in claim 16, wherein:

said sleeves have an adjustable length to fit the individual child wearing the toy.

* * * * *